US006726193B1

(12) United States Patent
Yates

(10) Patent No.: US 6,726,193 B1
(45) Date of Patent: Apr. 27, 2004

(54) QUICK POSITION CLAMP AND VISE

(76) Inventor: Howard Preston Yates, 1048 Gwill Rd., Mt. Juliet, TN (US) 37122

( * ) Notice: Subject to any disclaimer, the term of this patent is extended or adjusted under 35 U.S.C. 154(b) by 0 days.

(21) Appl. No.: 10/154,421

(22) Filed: May 23, 2002

Related U.S. Application Data

(60) Provisional application No. 60/292,999, filed on May 23, 2001.

(51) Int. Cl.[7] ..... B25B 5/10

(52) U.S. Cl. ..... 269/184; 269/249

(58) Field of Search ..... 269/184, 185, 269/186, 187, 249, 146

(56) References Cited

U.S. PATENT DOCUMENTS

| | | | | |
|---|---|---|---|---|
| 298,704 A | | 5/1884 | Norris et al. | |
| 754,962 A | * | 3/1904 | Bennett | 269/184 |
| 823,748 A | | 6/1906 | Walden | |
| 825,151 A | | 7/1906 | McLean | |
| 947,619 A | | 1/1910 | Orr | |
| 1,140,646 A | | 5/1915 | Abernathy | |
| 2,372,727 A | * | 4/1945 | Manning | 269/184 |
| 2,430,458 A | | 11/1947 | Farrell | |
| 3,357,698 A | | 12/1967 | Flynn | |
| 3,492,886 A | | 2/1970 | Naureckas | |
| 4,083,624 A | | 4/1978 | Timmer | |
| 4,262,892 A | | 4/1981 | Wu | |
| 4,534,547 A | | 8/1985 | Cox | |
| 4,753,427 A | | 6/1988 | Lodrick, Sr. | |
| 4,925,169 A | | 5/1990 | Lodrick, Sr. | |
| 5,241,736 A | | 9/1993 | Allison | |
| 6,098,973 A | | 8/2000 | Khachatoorian | |
| 6,250,621 B1 | | 6/2001 | Ping | |
| 6,296,241 B1 | | 10/2001 | Harrison | |

* cited by examiner

*Primary Examiner*—Robert C. Watson
(74) *Attorney, Agent, or Firm*—Waddey & Patterson; David B. Pieper; Phillip E. Walker

(57) ABSTRACT

A tension rod positioning apparatus and method for C-type clamps and Vises including a shaped threaded rod inserted into a shaped threaded hole on an engagement collar. When the shaped rod and shaped hole are aligned, the rod may be freely positioned within the collar. When the shaped rod is inserted into the collar and turned, the rod engages and turns the engagement collar. The engagement collar includes an external thread sized to fit an internal thread on a clamp base. In this manner, the rod may be inserted and then turned in one direction to both engage the engagement collar and increase the clamping pressure. After clamping, the shaped rod may be turned in the opposite direction to loosen the clamping pressure and disengage the engagement collar. Once the rod and collar have been disengaged by aligning the shaped rod and shaped hole of the engagement collar, the length of the rod may be freely moved within the engagement collar to reposition the clamp for the next operation.

2 Claims, 8 Drawing Sheets

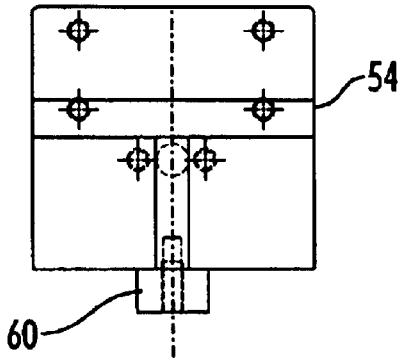
FIG. 16
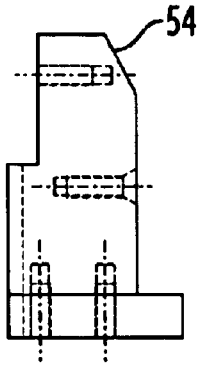
FIG. 17
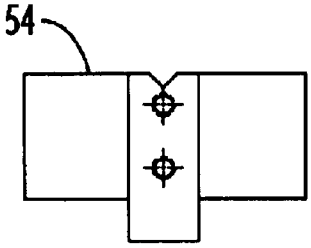
FIG. 20
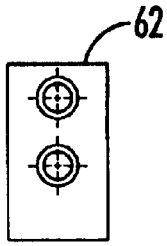
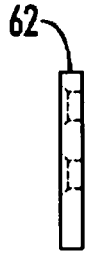
FIG. 18 FIG. 19
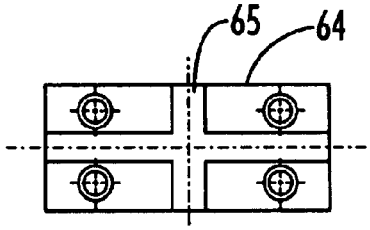
FIG. 21
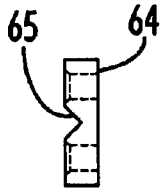
FIG. 23
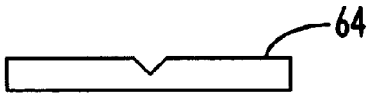
FIG. 22

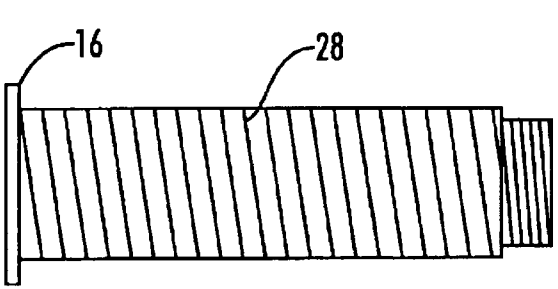
FIG. 26
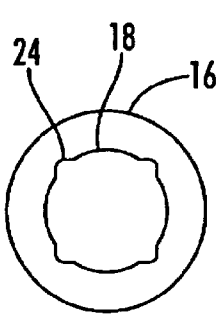
FIG. 25
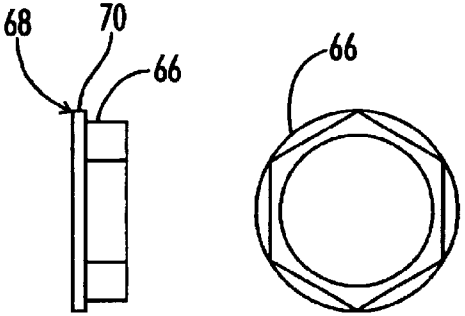
FIG. 27
FIG. 28
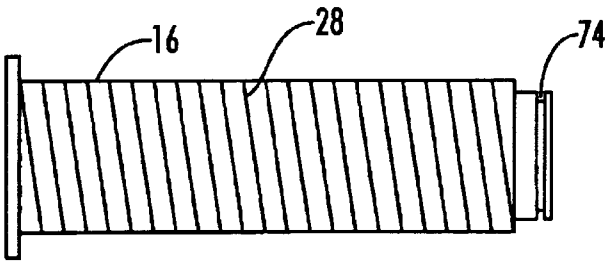
FIG. 30
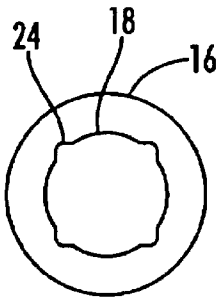
FIG. 29
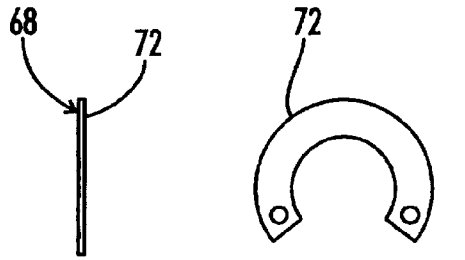
FIG. 31
FIG. 32

QUICK POSITION CLAMP AND VISE

APPLICATION FOR UNITED STATES LETTERS PATENT

This application claims benefit as a continuation-in-part of provisional U.S. Patent Application Ser. No. 60/292,999 filed May 23, 2001, entitled "Quick Position Clamp and Vise" which is hereby incorporated by reference.

Be it known that I, Howard Preston Yates, a citizen of United States, residing at 1048 Gwill Road, Mt. Juliet, Tenn. 37122; have invented a new and useful "Quick Position Clamp and Vise".

BACKGROUND OF THE INVENTION

The present invention relates generally to clamping systems and more specifically, this invention relates to c-clamps and vises and provides an improved quick position method and apparatus for use of these devices.

Several United States Patents describe clamping systems. These include: U.S. Pat. No. 298,704 issued to Norris et al. on May 13, 1884; U.S. Pat. No. 823,748 issued to Walden on Jun. 19, 1906; U.S. Pat. No. 825,151 issued on McLean on Jul. 3, 1906; U.S. Pat. No. 947,619 issued to Orr on Jan. 25, 1910; U.S. Pat. No. 1,140,646 issued to Abernathy on May 25, 1915; U.S. Pat. No. 2,430,458 issued to Farrell on Nov. 11, 1947; U.S. Pat. No. 3,357,698 issued to Flynn on Dec. 12, 1967; U.S. Pat. No. 3,492,886 issued to Naureckas on Feb. 3, 1970; U.S. Pat. No. 4,083,624 issued to Timmer on Apr. 11, 1978; U.S. Pat. No. 4,262,892 issued to Wu on Apr. 21, 1981; U.S. Pat. No. 4,534,547 issued to Cox on Aug. 13, 1985; U.S. Pat. No. 4,753,427 issued to Lodrick, Sr., on Jun. 28, 1988; U.S. Pat. No. 4,925,169 issued to Lodrick, Sr., on May 15, 1990; U.S. Pat. No. 5,241,736 issued to Allison on Sep. 7, 1993; U.S. Pat. No. 6,098,973 issued to Khachatoorian on Aug. 8, 2000; U.S. Pat. No. 6,250,621 issued to Ping on Jun. 26, 2001; and U.S. Pat. No. 6,296,241 issued to Harrison on Oct. 2, 2001. Each of these patents is hereby incorporated by reference.

Of particular note in this list of patents is U.S. Pat. No. 6,296,241, issued to Harrison on Oct. 2, 2001, entitled Adjustable C-Clamp. This patent describes an adjustable C-Clamp including a frame which receives a clamp cylinder at the top clamp seat. A slotted cylinder is then secured in the clamp cylinder such that a clamp rod may be moveably disposed in the slotted cylinder for a quick movement in and out of the cylinder. A clamp rod pin is positioned on the clamp rod to engage the slotted cylinder. The clamp rod pin is designed to traverse a pair of parallel, diametrically-opposed a longitudinally cylinder slots in the slotted cylinder to facilitate slideably adjusting the clamp rod in the slotted cylinder. Rotation of the clamp rod in the clamp cylinder seats the pins in a pair of multiple spaced-apart pin slots to provide for threaded extension of the clamp cylinder through the top clamp seat.

Also of interest is U.S. Pat. No. 946,619 issued to Orr on Jan. 25, 1910, which discloses a wrench. This patent describes the use of a shank with a flat side including teeth that are adapted to engage a toothed sleeve for positioning the jaws of the wrench. As can be noted by the disclosure of this patent, this teaching is limited in the available positioning of the jaws by the engagement of the teeth.

These prior art patents have several disadvantages including the available adjustment of the systems and the control of the pieces in relation to each other in these systems as well as the overall strength of the system provided by their means of connection. What is needed then is an improved positioning system for clamps and vises.

SUMMARY OF THE INVENTION

The present invention provides an improved tension rod positioning apparatus and method for C-type clamps and Vises. The present invention uses at least three teeth on a toothed rod inserted into a toothed hole on an engagement collar. When the rod and hole are aligned, the rod may be freely positioned within the collar. When the rod is inserted into the collar, the three teeth center the rod within the collar to provide an axial alignment of the rod with the hole. When the rod is then turned, the teeth of the rod provide the alignment of the rod and the hole and the turning action engages the rod teeth with the teeth of the engagement collar to turn the engagement collar. The multiple sets of teeth positioned along the rod and collar along with the axial alignment provided by the teeth provide an increased strength connection and an enhanced positioning for the rod to collar engagement. The engagement collar includes an external thread sized to fit an internal thread on the clamp base. In this manner, the rod may be inserted and turned in one direction to both engage and turn the engagement collar in order to increase the clamping pressure. After clamping, the rod may be turned in the opposite direction to both loosen the clamping pressure and disengage the engagement collar. Once the rod and collar have been disengaged by aligning the rod and hole of the engagement collar, the length of the rod may be freely moved within the engagement collar to reposition the clamp for the next operation.

BRIEF DESCRIPTION OF THE DRAWINGS

FIGS. 16 and 17 show the moving vise jaw.

FIGS. 18 and 19 show the cap for the bottom of the vise jaw.

FIG. 20 shows the bottom of the moving vise jaw.

FIGS. 21 through 23 show the clamp block for the vise jaw.

FIGS. 25–28 show the threaded insert and the retaining nut.

FIGS. 29–32 show the threaded insert and the retaining snap ring washer.

DESCRIPTION OF THE PREFERRED EMBODIMENTS

FIGS. 1 through 32 show the quick position C-type clamp 10 of the present invention. The opening and closing of the quick position C clamp 10 is a slide and final screw motion instead of the basic all screw method as taught in the prior art. The quick position "C" Clamp 10 is a time saving, labor saving tool. To open a conventional 6" "C" clamp requires approximately 1 to 2 minutes. To open and close the Quick position "C" Clamp 10 requires approximately 2 seconds.

The arrangement of the present invention also provides advantages over previous attempts of the prior art methods for C clamps.

Figure 1:
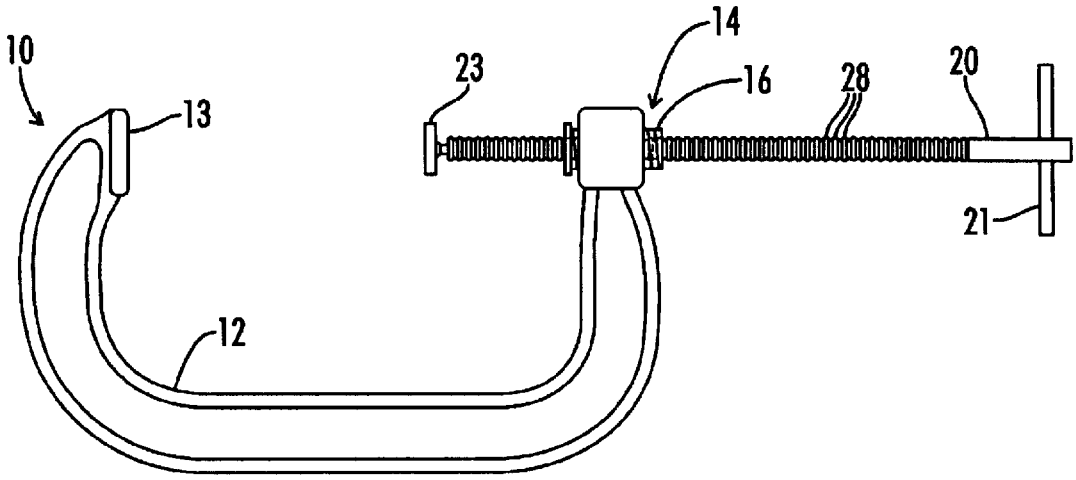
FIGS. 1 through 7 show the C-type clamp of the present invention.
Figure 2:
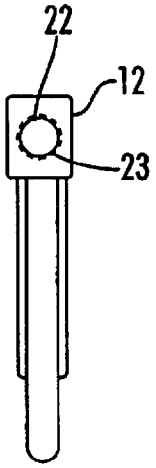
Figure 4:
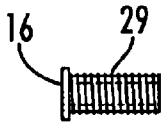
Figure 3:
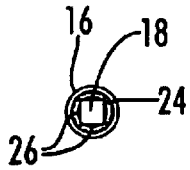
Figure 5:
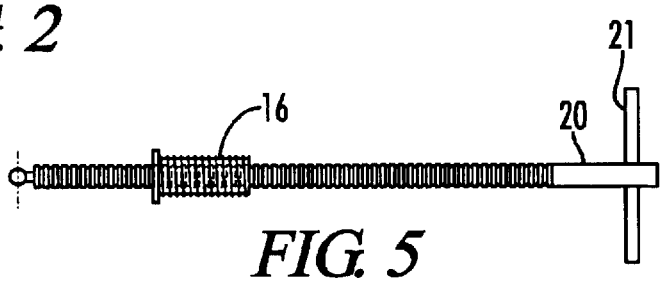
Figure 6:
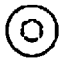
Figure 7:
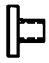
Figure 9:
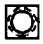
FIGS. 8 through 11 show the square bar rod lock assembly.
Figure 8:
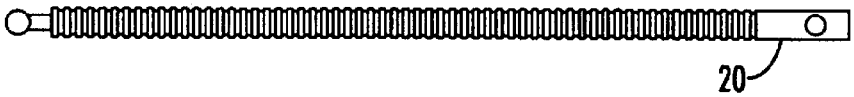
Figure 10:
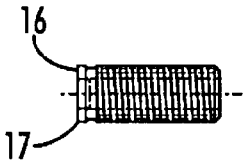
Figure 11:
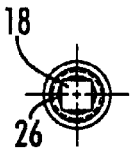

As shown in FIG. 1, the U-shaped or "C" clamp frame shown as the body 12 is manufactured of cast steel that is used to hold the pressure applied by the handle 21 through the threaded bar 20, also known as a rod 20 to the bearing pad 13. The sliding action consists of a bar lock assembly unit 14 shown in detail in FIGS. 3 through 11 that includes a square threaded bar 20 passing through internal threads 26 on a threaded insert 16 approximately 2¾" long, 1" in diameter. The threaded insert 16 includes both internal clamping threads 26 on an inside hole 18 and multiple rotation external clamping threads 29 on the outer diameter of the insert 16. The external thread 29 of the threaded insert 16 engages a threaded hole 22 housing a multiple rotation clamping thread 23 in the C clamp body 12. As the threaded insert 16 is screwed into and out of the C clamp body 12, the rotation provides a rotationally engaged clamping motion similar to the prior art threads on just the bar assembly. However, we should note that the threaded insert 16 only needs to provide a short range of rotational movement to provide clamping pressure. This is because the square threaded rod 20 provides the large movements for adjustment to the location of the object and the actual clamping position. While the present invention is shown as a square rod and square broach, a triangular rod and broach or other alternative shapes may be utilized for the rod and pass through opening. The important characteristics are the centering of the rod and the proper engagement of the rod to the insert to hold the clamping pressures associated with the size of the clamp or vise being used.

Rotational control of the threaded insert 16 is provided by the square threaded rod 20. The pass through opening, shown as hole 18, in the threaded insert 16 has been broached with a square broach 24 that is slightly smaller than the hole 18 such that it leaves four clamping thread teeth 26 on each un-broached rotation of the internal threads in the hole 18. The square bar 20 is sized to slide through the square broach 24 and has square grooves 28 sized to engage the remaining internal thread teeth 26. Thus, if the square of the bar 20 is aligned with the square broach 24 of the hole 18 then the rod 20 may pass easily into and out of the threaded insert 16 without a rotational movement. This allows for large adjustment of the clamping end of the rod 20 to the object being clamped. When the bar 20 is turned, the rod engages the threaded insert 16 and turns the insert 16. This operates to rotate the insert 16 inside the body 12 and use the external threads 29 of the insert 16 to close the distance inside the clamp 10 and increase the clamping pressure against the object. Thus, this forces the bar 20 against the object, clamping the object securely.

To release the object, the rod is simply turned to the left to disengage the threads 28 of the square rod 20 from the thread teeth 26 of the threaded insert 16. Once the thread teeth 28, 26 are disengaged and the square of the rod 20 is aligned with the square broach 24, the bar 20 may be slid out of the way to an open position to allow for removal of the object.

This design provides a further advantage because it allows the bar 20 to be replaced if bent or damaged. This contrasts with the prior art designs where the clamp 10 is scrapped when the bar 20 is bent or damaged. The driving pad 23 end of the bar 20 may be provided with threads to make removal of a driving pad 23 easier than normally associated with a pressed on driving pad 23.

FIGS. 12 through 15 show the quick position vise 50 base assembly 52, and FIGS. 16 through 23 show components of the moving vise 50 clamp jaw 54. The Quick position vise 50 was designed to slide open and close instead of the conventional screw in and out action of present day vises on the market. The vise 50 also has a jaw opening of 8" as compared to 4" to 5" of other vises. The vise 50 weighs approximately 20 lbs. Compared to other large vises with a 6" jaw opening that weight approximately 100 lbs.

The vise 50 is manufactured of cast steel, one-piece construction base 52 with a bearing jaw 51 and slide jaw 54 that clamps the object. The vise 50 incorporates a bar-lock assembly unit 14 shown in FIGS. 8 through 11 that consists of a threaded insert 16 1" in diameter with internal threads that have been broached by a square broach 24 leaving partial thread teeth 26 in which a square bar 20 with square thread teeth 28 will slide in and out. As the bar 20 is rotated by the handle 21, the edges of the square thread teeth 28 of the bar 20 engage the internal thread teeth 26 of the insert 16, which causes the insert 16 to rotate to the right, clamping the sliding jaw 54 against the object held in the base 52. To remove the object, simply make one turn of the handle counterclockwise and pull the clamping jaw 54 back. There is no other vise with these features that is this small that will permit a machinist, tool and die maker, etc. to store the vise 50 in the top of the KENNEDY (trademark), SNAP-ON (Trademark), or other personal tool box.

Figure 12:
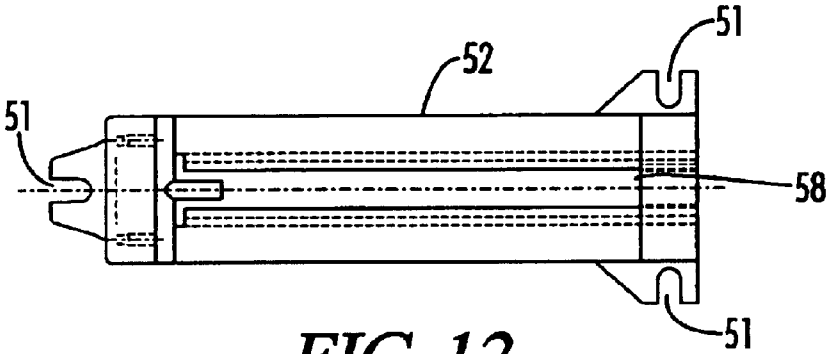
FIGS. 12 through 15 show the vise base assembly.
Figure 13:
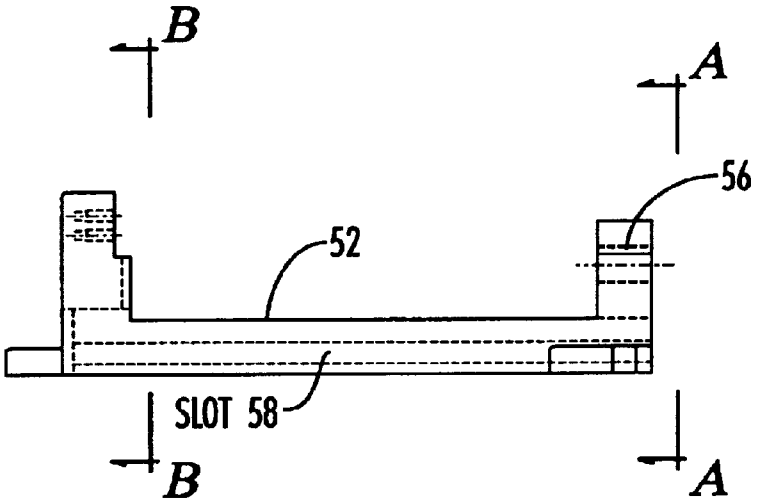
Figure 15:
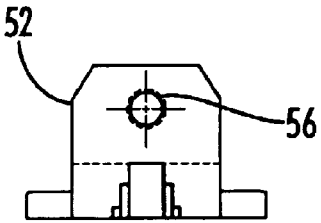
Figure 14:
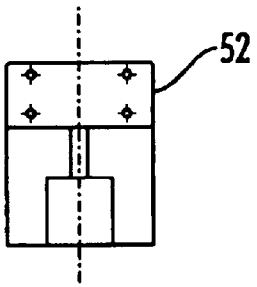

FIGS. 12 through 15 show the vise 50 base assembly 52. FIG. 12 shows a top view. FIG. 13 shows a side view. FIG. 14 shows a cut-away view along line B—B. FIG. 15 shows an end view from position A—A. The base 52 includes a threaded hole 56 for receiving the threaded insert 16 and a base slot 58 for receiving the bottom extension 60 of the vise jaw 54. Also shown are U-slots 51 for bolting the vise 50 to a stand.

FIGS. 16, 17, and 20 show the moving vise jaw 54 from the end, side, and bottom views respectively. The moving vise jaw 54 includes a bottom extension which passes through the base slot 58 in the base 52. The bottom cap 62 is bolted to the bottom extension 60 to hold the vise jaw 54 in the base 52. The design of a face plate 64 with v-slots 65 is shown in FIGS. 21 through 24.

Figure 24:
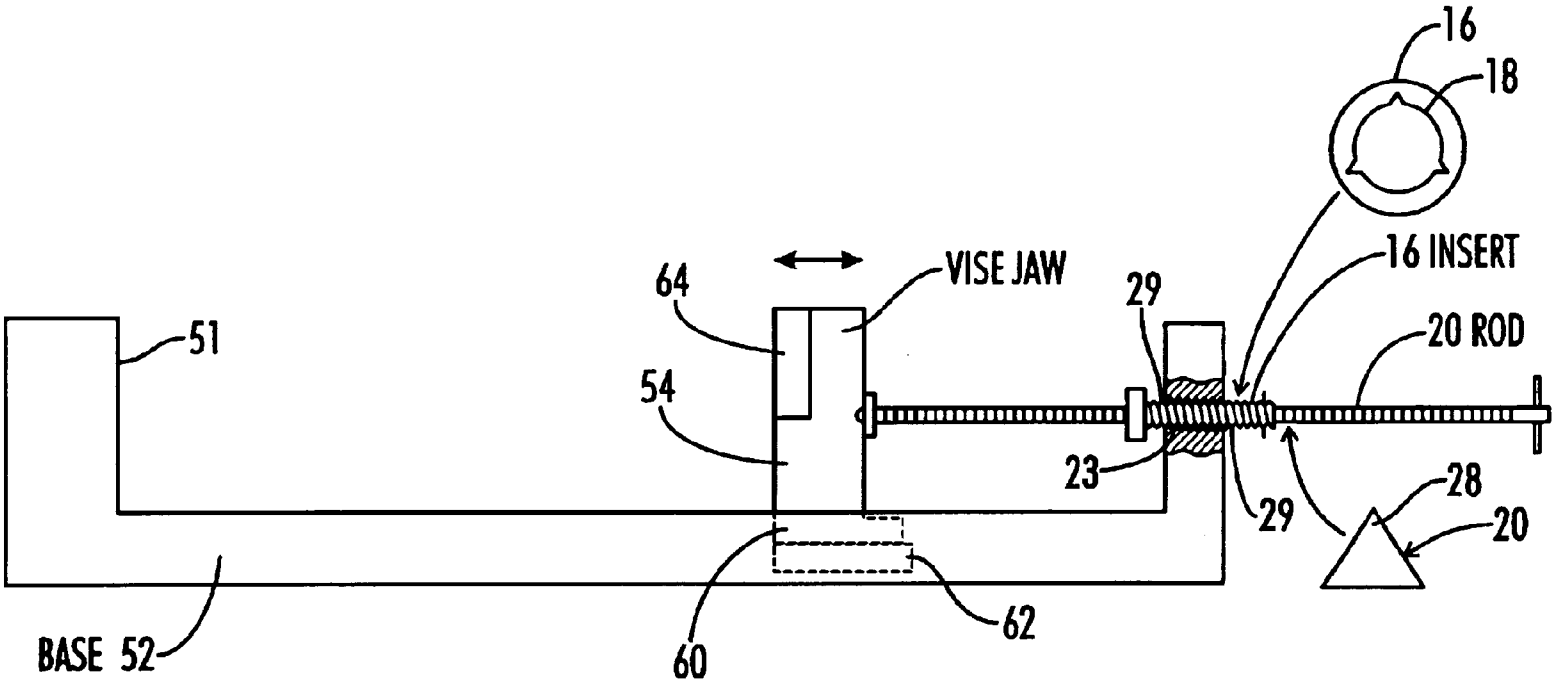
FIG. 24 shows the assembled vise.

FIG. 24 shows the assembled vise with the base 52 and the upright bearing jaw 51 mounted to the moving vise jaw 54 with the installed face plate 64 and the bottom cap 62 connected to the clamping shaft 20. The clamping shaft 20 is a triangular shaft with three extensions 28, previously shown as thread teeth 28, positioned around the shaft. An insert 16 is positioned on the clamping shaft 20 and defines a pass through opening 18 including extension receptors 26 previous shown as thread teeth 26. The receptors 26 are adapted to engage the extensions 28 and substantially center the shaft 20 inside the pass through opening 18. The insert 16 further defines a first clamping thread 29. The rotation of the clamping shaft 20 in relation to the insert 16 in a first direction engages the first extensions 28 into the receptors 26 to turn the insert 16, and rotation of the clamping shaft 20 in a second direction disengages the extensions 28 from the receptors 26 such that the clamping shaft 20 may freely slide through the pass through opening 18. The bearing jaw 51 is connected to the body or base 52 which defines a second clamping thread 23 adapted to engage the first clamping thread 29 to adjust the position of the insert 16 in relation to the body 52. A driving jaw 54 engages the clamping shaft 20 and is adapted to be driven to provide clamping pressure in relation to the bearing jaw 51. As previously described, stops 68 are connected to the insert 16 and adapted to limit the movement of the insert 16 in relation to the body 52.

FIGS. 25–28 show the threaded insert 16 with end connection threads 64 for a screw type of attachment for a retaining nut 66 with internal connection threads 67. The retaining nut 66 is screwed onto the threaded insert 16 to provide an insert stop 68 which is shown as a shoulder 70 on the retaining nut 66. As shown in FIGS. 29 through 32, this insert stop 68 may also be implemented by using a snap ring 72, or washer 72, which extends to form the insert stop 68 when it is placed on the retaining slot 74, also known as groove 74, on a snap ring style of threaded insert 16. Alternatively, a washer may be directly welded to the insert. It is important to remember that the external diameter of the metal snap ring 72 should extend outward past the threads 28 on the insert 16 to provide a shoulder to stop the insert 16 against the frame 12, also known as the body 12. Snap rings 72 with outside diameters close to the external diameter of the threads 28 can provide problems when the snap ring 72 contacts the internal body thread as they may try to into the snap ring 72 and create problems with the movement of the insert 16 within the frame 12.

Figure 33:
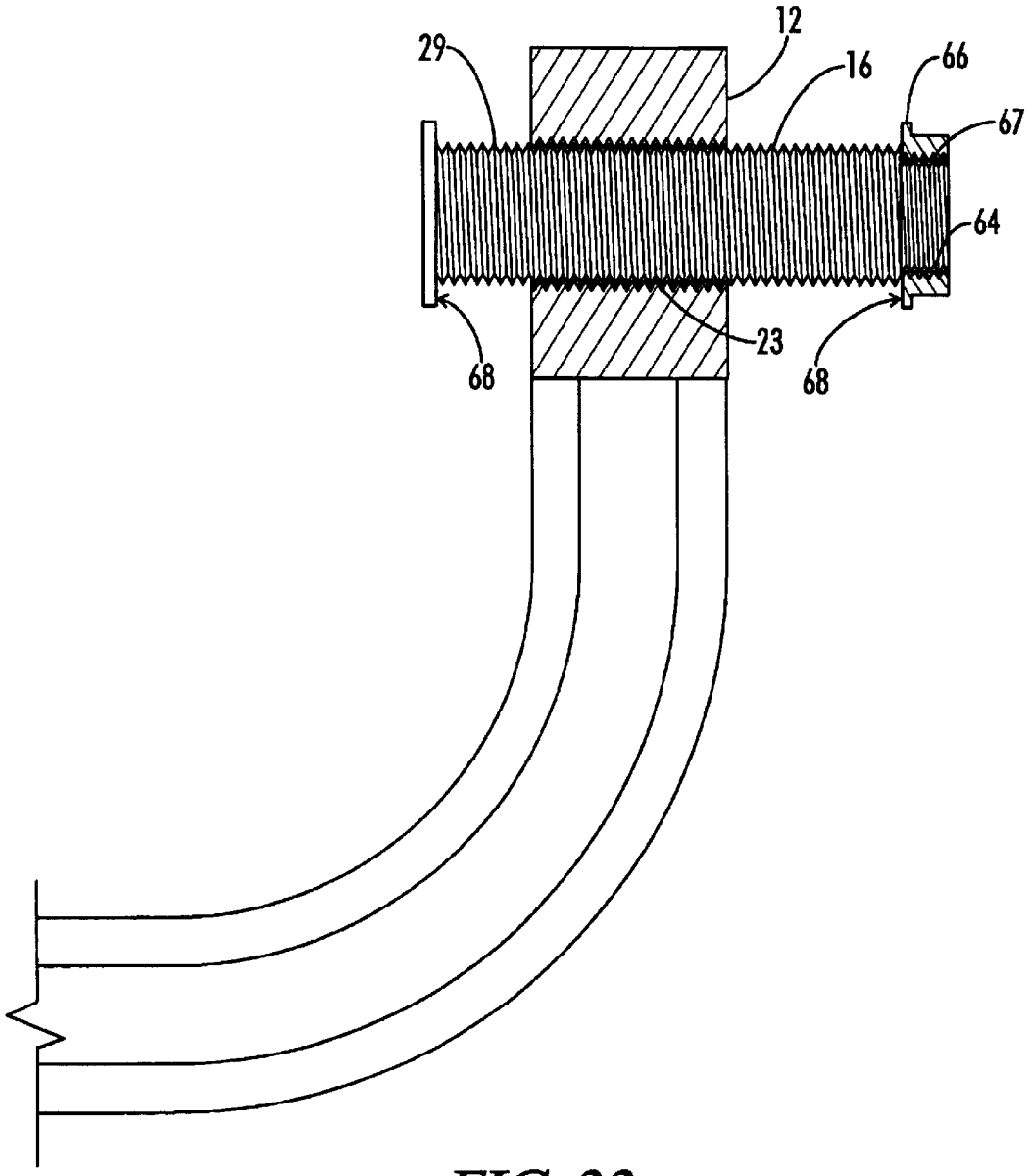
FIG. 33 shows a cutaway view of the threaded insert and retaining nut mounted in the body.

FIG. 33 shows a cutaway view of the threaded insert 16 and retaining nut 66 mounted in the body 12 from which it may be understood how a front shoulder 17 on the insert 16 and the nut shoulder 70 on the retaining nut 66 provide the insert stops 68 for the threaded insert 16. This allows the design to limit the exposure of the clamping threads on the insert to body connection to protect them over the life of the clamp. As shown in FIGS. 27, 28, and 33, the stop 68 may be a hex nut which is attached by internal threads on the hex nut to external threads on the insert to provide a shoulder 70 on the back of the insert 16 to retain the insert 16 within the frame body 12. In this matter, the insert 16 may be constructed with a front shoulder 17 to retain the insert 16 on one end and utilize the hex nut shoulder 70 on the back end to retain the insert 16.

Figures 34A, 34B, 34C, 34D:
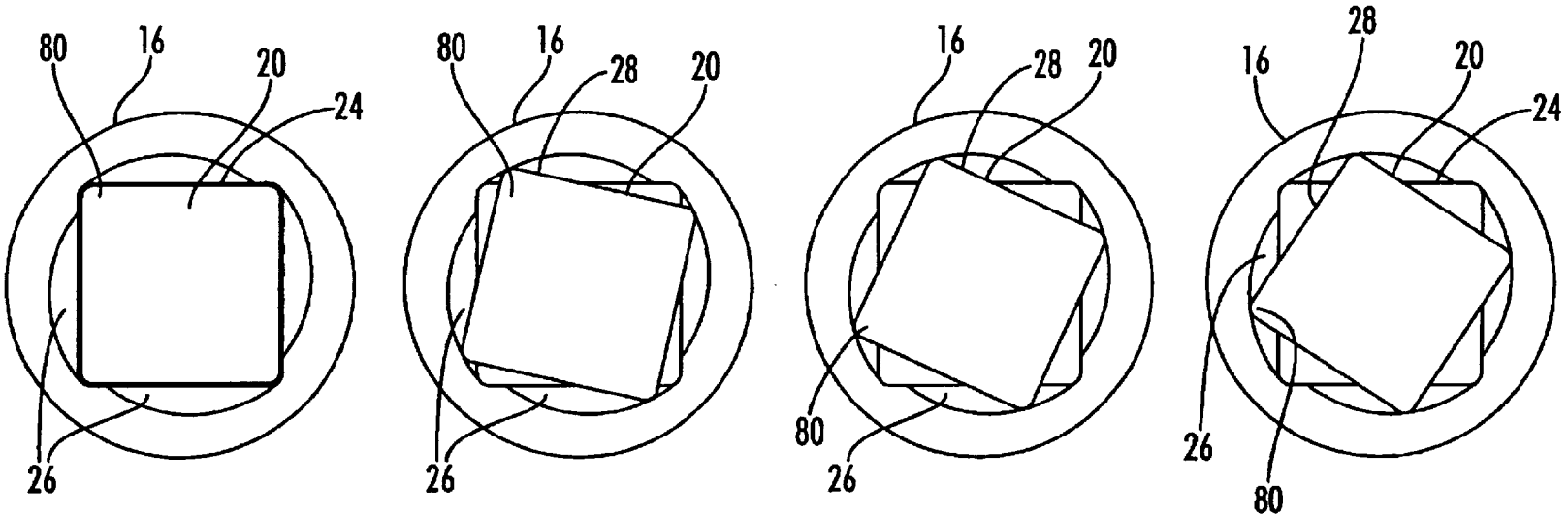
FIGS. 34A through 34D show the rotation of the square rod aligned with the square broach and rotated to engage the internal threads of the insert.

FIGS. 34A through 34D show the rotation of the square rod 20 in the square broach 24 between the aligned and threadably engaged positions. FIG. 34A shows the points 80 of the square rod 20 aligned with the edges of the square broach 24. In this position, the square rod 20 may easily slide through the insert 16. In FIGS. 34B through 34D one may see how the points 80 of the square rod 20 may be rotated to engage the internal threads 26 of the insert 16 while maintaining the alignment of the rod 20 inside the insert 16. A minimum of three contact areas are necessary to provide the proper alignment, but this may be implemented with a varying number of teeth according to alternative design embodiments.

Thus, although there have been described particular embodiments of the present invention of a new and useful Quick Position Clamp and Vise, it is not intended that such references be construed as limitations upon the scope of this invention except as set forth in the following claims.

What is claimed is:

1. A clamp, comprising:

a bearing pad, a frame connected to the bearing pad, the frame including a first clamping thread located distally from the bearing pad;

an insert defining a second clamping thread adapted to be screwably connected to the first clamping thread to adjust the position of the insert in relation to the frame;

the insert defining a pass through opening with first teeth;

a stop connected to the insert and adapted to limit the movement of the insert in relation to the frame the insert further defining a connection groove, the stop comprising a snap ring adapted to fit the connection groove; and a clamping shaft mounted inside the insert, the clamping shaft including at least three second teeth positioned around the shaft and adapted to engage the first teeth and substantially center the shaft inside the insert, wherein rotation of the clamping shaft in a first direction engages the first teeth into the second teeth to turn the insert in relation to the frame, and rotation of the clamping shaft in a second direction disengages the first teeth from the second teeth such that the clamping shaft may freely slide through the pass through opening.

2. A clamp, comprising:

a bearing pad, a frame connected to the bearing pad, the frame including a first clamping thread located distally from the bearing pad;

an insert defining a second clamping thread adapted to be screwably connected to the first clamping thread to adjust the position of the insert in relation to the frame;

the insert defining a pass through opening with first teeth;

a stop connected to the insert and adapted to limit the movement of the insert in relation to the frame the stop comprising a metal washer fixed to the insert; and a clamping shaft mounted inside the insert, the clamping shaft including at least three second teeth positioned around the shaft and adapted to engage the first teeth and substantially center the shaft inside the insert, wherein rotation of the clamping shaft in a first direction engages the first teeth into the second teeth to turn the insert in relation to the frame, and rotation of the clamping shaft in a second direction disengages the first teeth from the second teeth such that the clamping shaft may freely slide through the pass through opening.

* * * * *